US006375416B1

(12) United States Patent
Farrell et al.

(10) Patent No.: US 6,375,416 B1
(45) Date of Patent: Apr. 23, 2002

(54) TECHNIQUE FOR REDUCING ACOUSTIC RADIATION IN TURBOMACHINERY

(76) Inventors: Kevin J. Farrell, 1312 Curtin St., State College, PA (US) 16803; Walter S. Gearhart, 448 Orlando Ave., State College, PA (US) 16801

( * ) Notice: Subject to any disclaimer, the term of this patent is extended or adjusted under 35 U.S.C. 154(b) by 0 days.

(21) Appl. No.: 08/092,630

(22) Filed: Jul. 15, 1993

(51) Int. Cl.[7] ..... F01D 25/04

(52) U.S. Cl. ..... 415/119; 415/10; 415/118; 415/128; 415/173.1; 415/173.2; 415/173.5; 415/914; 60/725

(58) Field of Search ..... 415/10, 118, 119, 415/126, 128, 170.1, 171.1, 173.1, 173.2, 173.5, 914; 60/725; 181/210, 214

(56) References Cited

U.S. PATENT DOCUMENTS

| | | | | |
|---|---|---|---|---|
| 3,286,914 A | | 11/1966 | Baverstock | |
| 3,832,085 A | | 8/1974 | DeFauw et al. | |
| 3,893,782 A | * | 7/1975 | Pierpoline et al. | 415/119 |
| 3,893,787 A | | 7/1975 | Jones | |
| 4,050,845 A | * | 9/1977 | Gemein et al. | 415/119 |
| 4,086,022 A | * | 4/1978 | Freeman et al. | 415/119 |
| 4,104,002 A | | 8/1978 | Ehrich | |
| 4,239,452 A | | 12/1980 | Robert, Jr. | |
| 4,466,772 A | | 8/1984 | Okapuu et al. | |
| 4,531,362 A | | 7/1985 | Barry et al. | |
| 4,540,335 A | * | 9/1985 | Yamaguchi et al. | 415/173.5 |
| 4,714,406 A | | 12/1987 | Hough | |
| 4,738,586 A | | 4/1988 | Harter | |
| 4,781,530 A | * | 11/1988 | Lauterbach | 415/173.1 |
| 5,256,031 A | * | 10/1993 | Bothien et al. | 415/119 |

* cited by examiner

*Primary Examiner*—Edward K. Look
*Assistant Examiner*—Christopher Verdier
(74) *Attorney, Agent, or Firm*—Perman & Green, LLP

(57) ABSTRACT

Apparatus for reducing acoustic radiation which occurs during the operation of turbomachinery includes a shroud having a generally cylindrical inner surface and a coaxial rotor having a plurality of blades extending generally radially outwardly at equally spaced circumferential locations. The inner surface of the shroud is circumferentially contoured such that the tip clearance between each of said blades and the inner surface is caused to vary in a periodic manner upon rotation of said rotor. This creates a new periodic unsteady pressure field which is substantially equal to, and out of phase with, an existing periodic pressure field resulting from nonuniform inflow into the blades and results in the radiation from the turbomachinery of reduced blade rate frequency tones. The inner surface of the shroud may have a circumferential sinusoidal contour whose periodicity is an integral multiple of the number of the blades. A plane of the tip end of each blade, or attack plane, is preferably angularly disposed relative to a plane perpendicular to the axis of the shroud and the contoured inner surface includes a plurality of parallel grooves generally aligned with the attack plane of each of the blades. Additionally, the shroud may be indexed about its longitudinal axis until an optimized reduction of blade rate frequency tones has been achieved. Furthermore, the inner surface of the shroud may be defined as a Fourier series enabling a simultaneous reduction of a plurality of harmonics of the blade rate frequency tones.

14 Claims, 9 Drawing Sheets

TECHNIQUE FOR REDUCING ACOUSTIC RADIATION IN TURBOMACHINERY

GOVERNMENT SPONSORSHIP

This invention was made with Government support under Contract N00039-88-C-0051 awarded by the U. S. Department of the Navy. The Government has certain rights in the invention.

BACKGROUND OF THE INVENTION

1. Field of the Invention

The present invention relates generally to turbomachinery and, more particularly, to a method of, and apparatus for, both passively and actively reducing the noise energy caused by turbomachinery.

More specifically, a primary purpose of this invention is to reduce the blade rate frequency (BRF) tones which radiate from turbomachinery. The acoustic radiation can be an irritant to personnel and may excite other adjacent structure into vibration. By minimizing the net unsteady pressure field on the blades, the level of radiated sound can be reduced. The approach of this invention is to create an unsteady pressure field that is out of phase with the existing unsteady pressure field acting on the blades. A variable tip clearance around the periphery of the rotor is used to create this unsteady pressure field. Additionally, the variable tip clearance shroud can be rotated with respect to a stationary frame to obtain the necessary phase relation for tone reduction. The invention is conducive to adaptive control methods, where the shroud position is adjusted until an acoustic signal is minimized.

2. Discussion of the Prior Art

The principal noise sources of an axial-flow turbomachine can be attributed to the viscous flow over the airfoils or blades. The acoustic spectrum is characterized by broadband radiation and discrete frequency tones occurring at integer multiples of the BRF. Broadband noise can be attributed to the shedding of vorticity from the blade trailing edges and from pressure fluctuations in regions of unsteady and turbulent flow. Discrete frequency noise is due both to the steady and unsteady blade loading.

Several design expedients are currently used to achieve some tonal reduction, such as blade-row vane number, blade-row spacing, skew distribution, shaft speed and isolation. For a given design, BRF noise can be accomplished by reducing the nonuniformities in the flow which are the principal cause of unsteady blade loads and subsequent discrete frequency noise. By eliminating flow obstructions or placing them far from the turbomachine, flow nonuniformities can be reduced. While these are effective to varying degrees, the discrete tones require further reduction. The various methods of controlling this unsteadiness have been classified as either active or passive.

Active control describes a class of techniques in which external energy is introduced to cancel the existing acoustic sources. A system of speakers and microphones are used to synthesize "anti-noise" of the appropriate frequency content which minimizes the error signal from the microphone. These systems are difficult to implement physically. Active control also describes methods which generate unsteady fluid dynamic forces to reduce unsteadiness. In many circumstances, robust actuators of sufficient response time are not available.

Passive control denotes methods which take advantage of the unique physics of the particular flow situation to reduce the net acoustic radiation. The muffler on an automobile would be an example of a passive control device. Passive methods are generally less complex and less expensive than active control methods.

The present invention incorporates both active and passive noise control techniques. In its rudimentary form, the technique is passive. Adaptive, yet passive control can be utilized with the addition of a feedback loop which minimizes the measured acoustic radiation at select BRF harmonic tone(s). The benefits of the concept can be further extended by incorporating active techniques with additional mechanical complexity.

Generally typical of the prior art relating to noise suppression in turbomachinery are the following U.S. patents:

- U.S. Pat. No. 4,531,362 issued Jul. 30, 1985 to Barry et al.;
- U.S. Pat. No. 4,104,002 issued Aug. 1, 1978 to Ehrich;
- U.S. Pat. No. 3,832,085 issued Aug. 27, 1974 to DeFauw et al.; and
- U.S. Pat. No. 3,286,914 issued Nov. 22, 1966 to Baverstock.

Numerous other patents have been studied by the applicants. While in many instances they appear, at first glance, to have the physical features of the subject invention, in fact, they are really directed to the enhancement of aerodynamic performance, such as efficiency and stall margin.

Of the more pertinent patents, Baverstock utilizes a scroll surrounding a centrifugal fan which is perforated and accordion-shaped in a direction parallel to the rotor axis, such that a cross section shows a saw-tooth or zig-zag pattern. Behind the scroll is sound absorbent material which is backed by the casing. This concept is unique to centrifugal fans and concerns sound absorption, only. It is now widely known that the principal noise sources in a centrifugal fan are at the cutoff of the scroll, a concept not addressed in the patent.

Erich discloses an acoustic duct for a gas turbine engine. In this instance, sound-absorbing linings for the inlet of the engine are placed in a helical pattern to absorb spinning mode acoustical energy. Noise suppression is maximized by aligning the angle of the helix to the direction of the wave front generated by the first stage of the rotor. In several variations of the invention, alternate strips have different widths which accommodate absorption at a number of different frequencies, or acoustically treated strips are alternated with untreated strips. In summary, noise is suppressed in a compressible flow duct by scattering spinning mode acoustic pressure fields through the use of circumferentially spaced and helically extended strips of sound-absorbing material.

In the Barry et al. patent, cavities surrounding the shroud or end-wall of an engine fan are tuned for resonance at the known flutter frequency of the rotor, the concept being aimed at reducing blade flutter and the subsequent high blade stresses and possibility of failure. The cavities are placed around and beneath the circumference of the end-wall and communicate to the duct through openings in the end-wall near the tips of the blades. This method of reducing flutter is superior to earlier known part-span shrouds, or clappers, which add weight and manufacturing cost. The cavities are arranged with axes parallel to the extent of the end-wall. Their length is determined to be one quarter of the wavelength of the known flutter frequency. When the cavities resonate at the appropriate frequency, the pressure-waves at the openings of the tubes are out of phase with the incoming waves, thereby achieving partial cancellation of the incoming pressure waves. The openings of the cavities are staggered within sets of four. The first of the four has an opening near the leading edge of the blade, and the last of the four has an opening near the trailing edge of the blade.

The most relevant of the patented techniques known to the applicants is disclosed in DeFauw et al. In this patent, a shroud surrounding an automotive axial-flow fan is provided with circumferentially spaced projections from the internal surface which are said to reduce the fan-shroud combination noise level. The shroud projections have a finger-like appearance, are oriented parallel to the shroud axis, equally spaced, and tapered on the upstream end. The mechanism of noise reduction is claimed to be the circumferentially undulating pattern to the axial flow of air past the shroud, not the rotor. The number of projections is not mentioned and, therefore is seemingly unimportant. Additionally, the large tip clearance illustrated in the drawing would not be effectual in modifying the unsteady forces on the rotor. In summary, the DeFauw patent utilizes the shroud aerodynamics, rather than an additional source of unsteadiness or noise, to reduce the fan shroud combination broadband noise level.

It was with knowledge of the prior art as just described that the present invention has been conceived and is now reduced to practice.

SUMMARY OF THE INVENTION

In accordance with the invention, apparatus is disclosed for reducing acoustic radiation which occurs during the operation of turbomachinery. The apparatus of the invention includes a shroud having a generally cylindrical inner surface and a coaxial rotor having a plurality of blades extending radially outwardly at equally spaced circumferential locations. The inner surface of the shroud is circumferentially contoured such that the tip clearance between each of said blades and the inner surface is caused to vary in a periodic manner upon rotation of said rotor. This creates a new periodic unsteady pressure field which is substantially equal to, and out of phase with, an existing periodic pressure field resulting mainly from nonuniform inflow into said blades and results in the radiation from the turbomachinery of reduced blade rate frequency tone(s). The inner surface of the shroud may have a circumferential sinusoidal contour whose periodicity is an integral multiple of the number of the blades. A plane of the tip end of each blade, or attack plane, is preferably angularly disposed relative to a plane perpendicular to the axis of the shroud, and the contoured inner surface includes a plurality of parallel grooves generally aligned with the attack plane of each of the blades. Additionally, the shroud may be indexed about its longitudinal axis until an optimized reduction of blade rate frequency tones has been achieved. Furthermore, the inner surface of the shroud may be defined as a Fourier series enabling a simultaneous reduction of a plurality of harmonics of the blade rate frequency tones.

In the present invention, a shroud containing equally-spaced projections from its internal surface is used to reduce the fan-shroud combination noise level by creating a circumferentially undulating pattern to the tip clearance. The present invention differs significantly from the prior art in that an additional source of unsteady force is generated on the rotor by the variable tip clearance which is out-of-phase with existing unsteady forces on the fan, thereby reducing the acoustic radiation from the fan at blade passage frequency and multiples concurrently. The level of cancellation is determined by the shroud or end-wall geometry and the proper angular orientation of the end-wall with respect to the inflow disturbances. The technique of the subject invention is inherently self-tuning and lends itself readily to the advantages of passive adaptive control in the event of variations in the fan inflow.

Accordingly, a primary object of the invention is to provide a method of, and apparatus for, both passively and adaptively reducing the noise energy level caused by turbomachinery.

Another object of the invention is to provide a shroud or end-wall for a multi-bladed fan rotor constructed with a contour whereby the clearance between the shroud and the tips of the blades caries with rotation, thereby reducing the discrete frequency tones which are generated. For purposes of the invention, it makes no matter whether the blades rotate relative to the shroud or the shroud rotates relative to the blades.

A further object of the invention is to provide such an expedient which, in one instance, is passive, requiring no external energy source, and in another instance is active, requiring external energy.

Still another object of the invention is to provide a noise abatement technique which is less complicated than other techniques. According to the technique of the invention, a sinusoidally shaped shroud or end-wall replaces an existing smooth end-wall and requires no other alterations.

Yet another object of the invention is to provide reduction of several harmonics of the BRF tones which may be achieved simultaneously by employing an end-wall or shroud contour whose inner surface is defined as a Fourier series.

Additionally, the technique of the invention can be made adaptive yet passive for other inflow conditions by employing an actuator to rotate the end-wall until the acoustic radiation, as determined by a microphone or hydrophone, is minimized. Inflow conditions change to the turbomachine when system losses vary, such as valve closure or the introduction of new system Components such as elbows, obstructions or additional lengths of duct.

Time variations of tip clearance rather than spatial variations of the tip clearance could also be achieved using a method of active control to move the end-wall in the radial direction. In this instance, the periodicity of the end-wall, and hence high harmonic numbers, would not be limited by machining capability.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate some of the embodiments of the invention, and, together with the description, serve to explain the principles of the invention in general terms. Like numerals refer to like parts throughout the disclosure.

DETAILED DESCRIPTION OF THE PREFERRED EMBODIMENT

Figure 1:
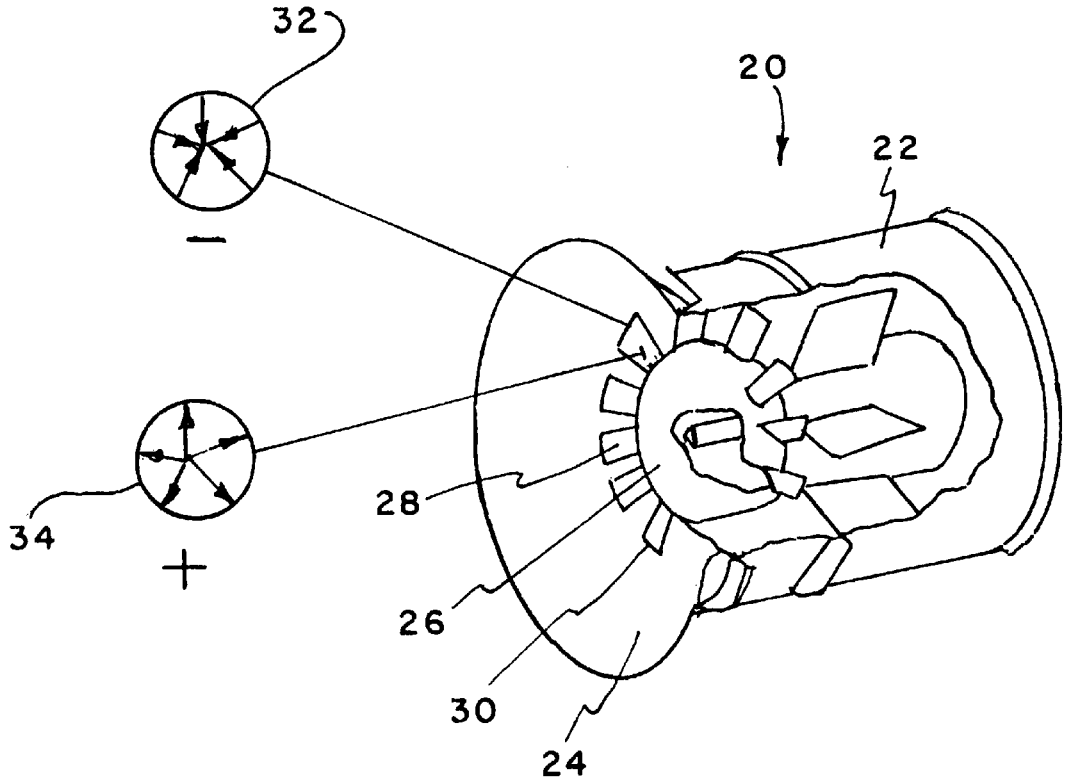
FIG. 1 is a diagrammatic perspective view of turbomachinery embodying the present invention.

Turn now to the drawings and, initially, to FIG. 1 which diagrammatically depicts a fan 20 or other suitable turbomachine comprising a shroud or end-wall 22 which has a generally cylindrical inner surface 24. A rotor 26 is coaxial with the shroud 22 and includes a plurality o f uniformly shaped and sized blades 28 which extend generally radially outwardly to tip ends 30. The tip ends 30 are proximate to the inner surface 24 and the blades 28 are positioned at equally spaced circumferential locations on the rotor 26. In a known fashion, the rotor 26 is rotatably mounted within the shroud 22. However, it should be understood that the invention, yet to be described, is effective so long as there is relative motion between the tip ends 30 and the inner surface 24, whether the rotor 26 rotates relative to the shroud 22 or the shroud becomes a rotating spool and the rotor becomes a stator.

Figure 2:
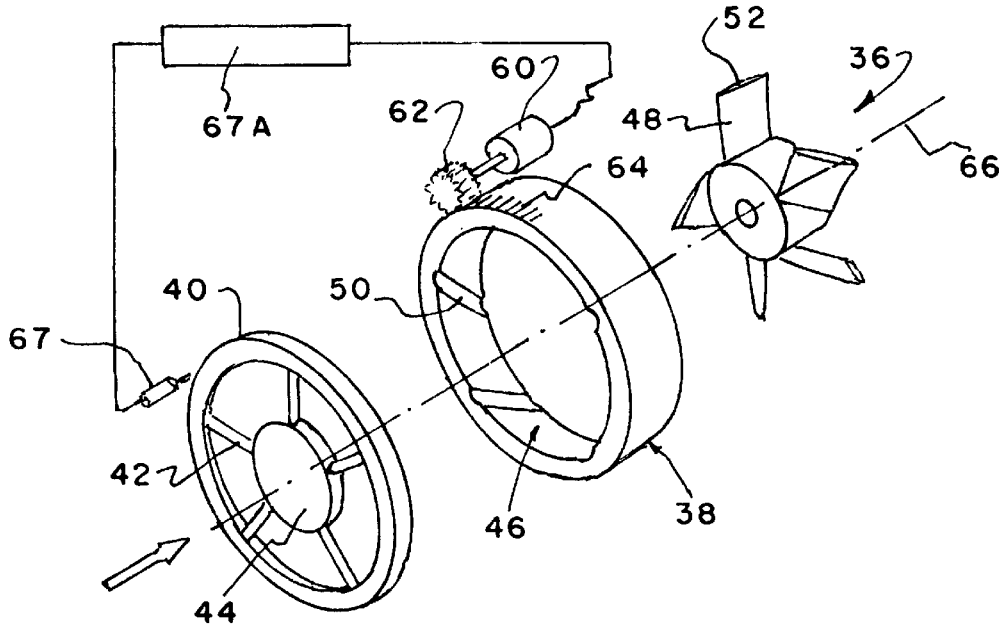
FIG. 2 is a diagrammatic exploded perspective view presenting the invention in greater detail.
Figure 3A:
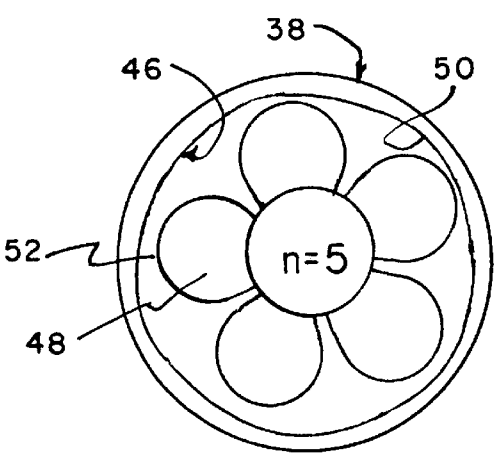
FIGS. 3A, 3B, and 3C are end elevation views of the machinery illustrated in FIGS. 1 and 2 and depicting shrouds having circumferentially contoured inner surfaces providing sinusoidal variations of five, ten, and fifteen periods, respectively.
Figure 4A:
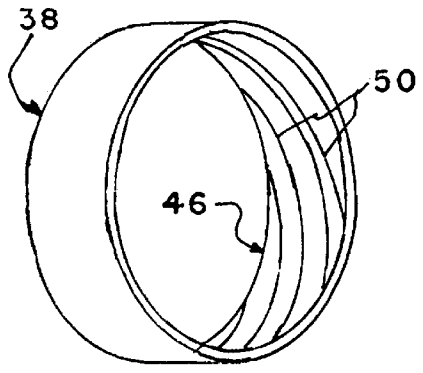
FIGS. 4A, 4B, and 4C are perspective views illustrating, diagrammatically, respectively, the shrouds of FIGS. 3A, 3B, and 3C.

In any event, the tip clearance between adjacent components in relative motion, that is, between the tip end 30 and the inner surface 24, is a source of noise. However, it has been found that by varying the tip clearance in a periodic manner around the shroud 22, a new periodic unsteady pressure field, as schematically represented by reference numeral 32 in FIG. 1, can be generated, which, when properly phased with an existing periodic pressure field, as represented by a reference numeral 34 in FIG. 1, can result in the reduction of the fundamental blade rate frequency (BRF) tone and multiples. In a proof-of-concept experiment, as diagrammatically depicted in FIG. 2, a five bladed cooling fan rotor 36 was placed in a short shroud 38 and, upstream therefrom, an artificial flow disrupter 40 with five flow disturbances 42 thereon. The flow disturbances 42 may be, for example, radially extending posts which are circumferentially spaced around a hub 44. An inner surface 46 of the shroud 38 is formed with a sinusoidal variation of five periods in keeping with the number of blades 48 on the fan rotor 36. Each sinusoidal period is depicted in FIG. 2 as a groove 50 which is generally aligned with the angle of attack of a tip end 52 of each of the blades 48. In actual fact, the sinusoidal variation of the inner surface 46 is a smooth contour without abrupt ridges, or the like. This is particularly well seen in FIGS. 3A and 4A. Hence, viewing FIG. 3A, the apex of each groove 50 is located adjacent to the region at which the shroud 38 is thinnest, recognizing that the outer peripheral surface of the shroud is a surface of revolution.

Figure 5:
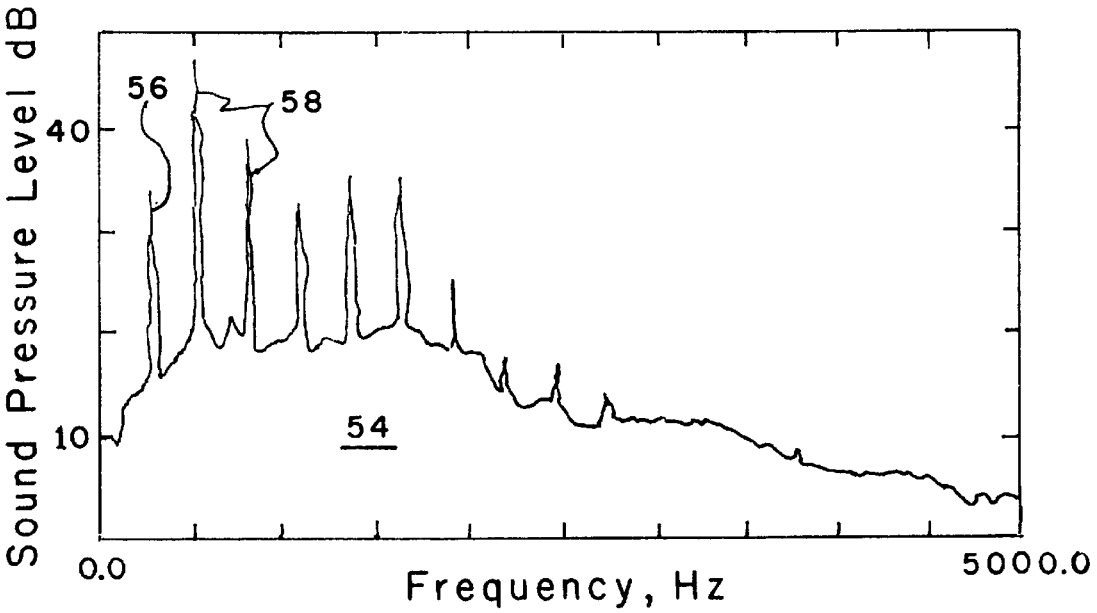
FIG. 5 is a graph presenting an acoustic spectrum of a typical axial flow turbomachine.

Since the periodicity of the shroud 38 is five, and the number of blades 48 is five, an unsteady pressure field at the blade rate frequency (BRF) is generated. It was earlier noted that the principle noise sources of an axial flow turbomachine can be attributed to the flow over the blades. This is indicated in FIG. 5 which is a plot of relative sound pressure level (SPL) versus frequency over a range of 0 to 5,000 Hertz. As indicated in FIG. 5, the acoustic spectrum is characterized by broad band radiation 54 and a plurality of discrete frequency tones beginning at a fundamental tone 56 at the BRF and a plurality of harmonic tones 58 present at discrete frequencies occurring at integer multiples of the fundamental BRF. Also as noted earlier, broadband noise or radiation 54 can be attributed to the shedding of vorticity from the trailing edges of the blades 48 and from pressure fluctuations in regions of unsteady and turbulent flow. Discrete frequency noise, as represented collectively by the tones 56 and 58 is due both to the steady and unsteady blade loading.

It has been found that rotation of the shroud 38 and its cylindrical inner surface 46 relative to airflow disturbances upstream thereof is desirable until the BRF tone 56 is minimized. This can be achieved as diagrammatically depicted in FIG. 2 by means of a suitable actuator 60 and associated pinion 62 drivingly engaged with an annular rack 64 integral with an outer surface of the shroud 38. Hence, operation of the actuator 60 is effective to rotate, or index, the shroud 38 and, with it, the grooves 50 about a longitudinal axis 66 until the BRF tone 56 and/or multiple tones 58 are minimized.

Such minimized BRF tones can be determined by placement of a suitable microphone 67 in the region of the air inlet to the shroud 38. Through a suitable controller 67A, the actuator 60 is operated until the BRF tone(s) are minimized.

Figure 6:
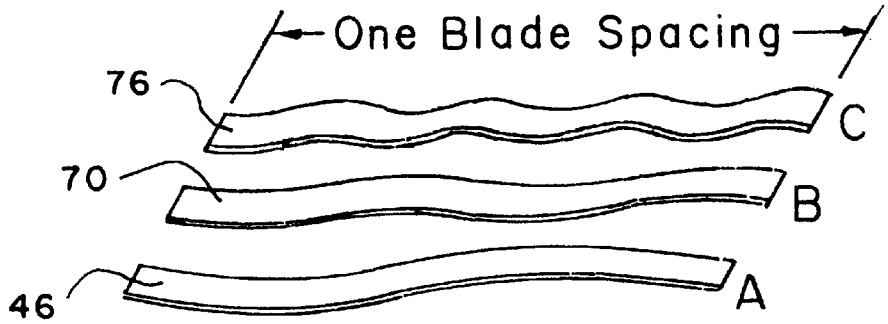
FIGS. 6A, 6B, and 6C depict the cylindrical development of the inner surfaces, for one blade spacing, and relating generally to FIGS. 3A, 3B, and 3C, respectively.
Figure 3B:
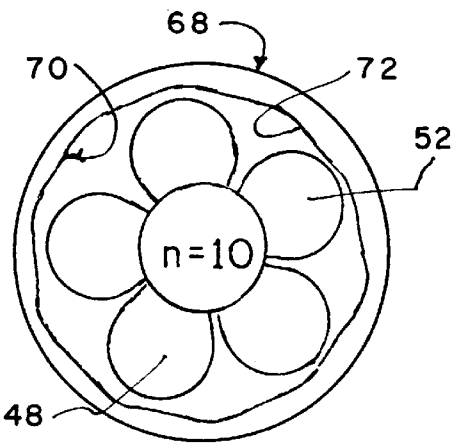

The experiment described above was then repeated utilizing shrouds with inner surfaces having sinusoidal variations of 10 and 15 periods, respectively. Specifically, as seen in FIGS. 3B and 4B, a modified shroud 68 is provided with an inner surface 70 with 10 grooves 72 therein. Similarly, in FIGS. 3C and 4C, a further modified shroud 74 has an inner surface 76 with a sinusoidal variation of 15 periods as indicated by the grooves 78. The shrouds 68 and 74 achieved reduction at the second and third harmonics of BRF, respectively. FIGS. 6A, 6B, and 6C depict, respectively, the cylindrical development of the inner surfaces 46, 70, and 76 for a single blade spacing of the rotor.

Figure 7:
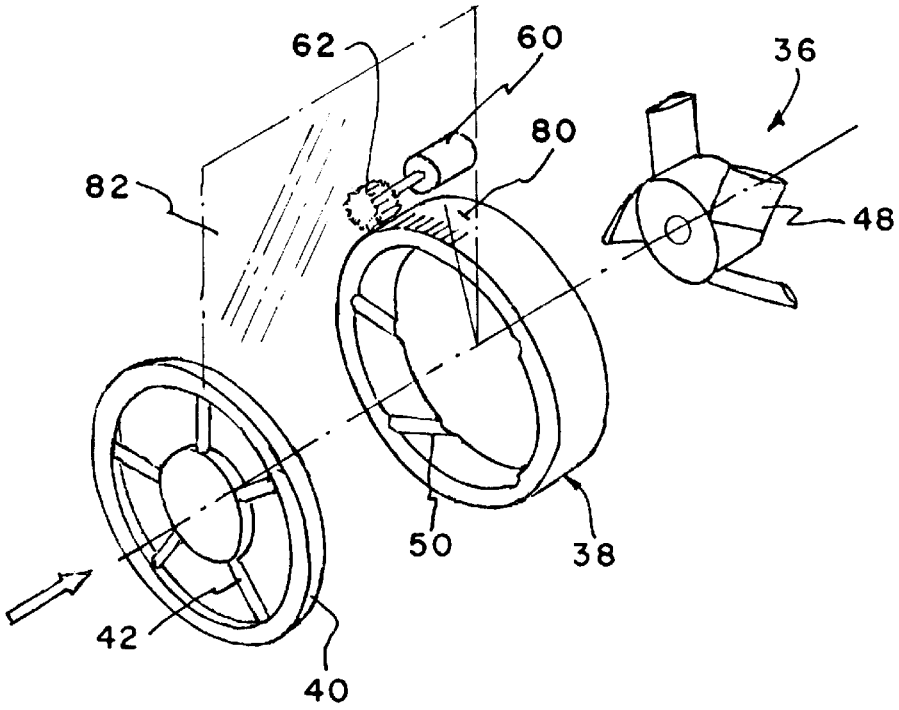
FIG. 7 is a perspective exploded view, similar to FIG. 2, for describing rotation of a shroud modified according to the invention and being indexed relative to the reference plane.
Figure 8A:
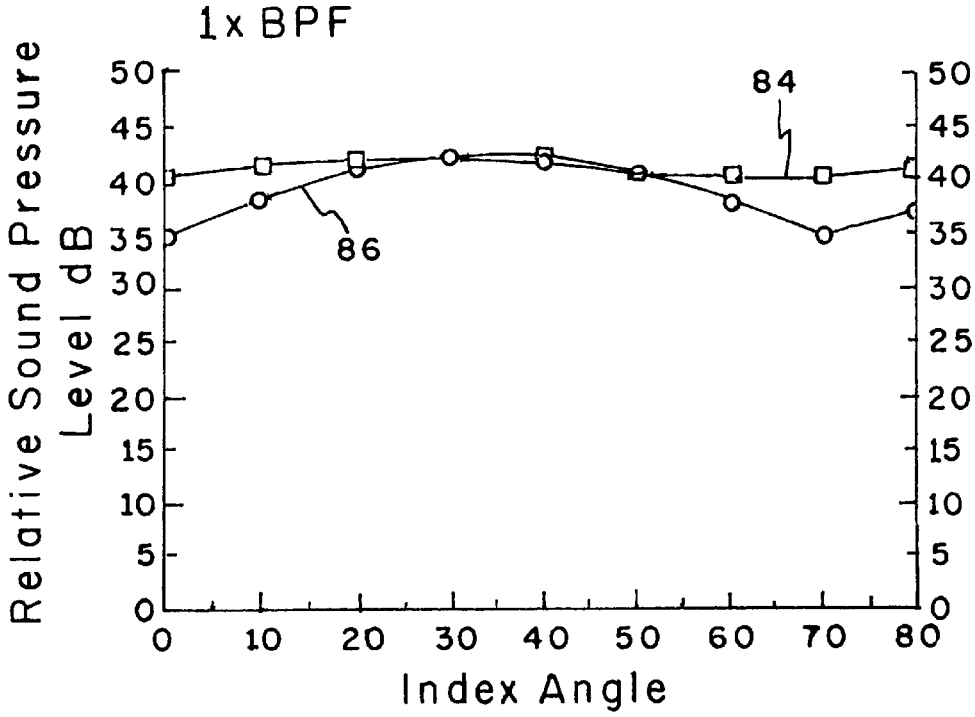
FIGS. 8A, 8B, and 8C are graphs, respectively, depicting minimum sound pressure levels achieved by the constructions of FIGS. 3A, 3B, and 3C, respectively.

FIG. 7, which is similar to FIG. 2, depicts rotation of the shroud 38 about its longitudinal Axis by means of the actuator 60 through an index angle 80 relative to an imaginary reference plane 82. In each of FIGS. 8A, 8B, and 8C, the imaginary reference plane 82 is defined as having an index angle of 0°. FIG. 8A is a graph comparing the relative sound pressure level, in decibels, of a smooth inner surface for a shroud with the modified surface 46 of the shroud 38. The curve 84 is representative of the BRF of a smooth inner surface while curve 86 is representative of a five cycle tip clearance variation in the inner surface 46. It will be noted that minimum sound pressure levels (SPLs) are achieved at two index angles, one in the reference plane (0°) and one at approximately 70°.

Figure 8B:
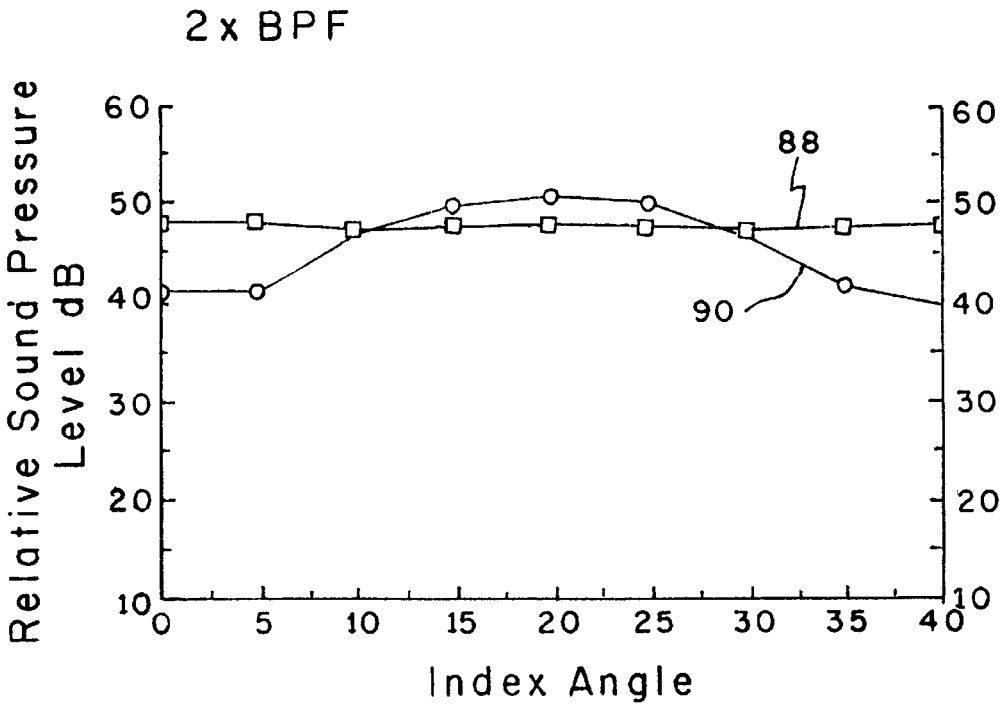

FIG. 8B relates to the constructions of FIGS. 3B, 4B, and 6B. In this instance, curve 88 represents a smooth inner surface and curve 90 represents a sinusoidal variation of ten periods as occurs in the inner surface 70 of the shroud 68. In this instance, while the SPL is low at approximately 0°, 5°, and 35°, it is an absolute minimum at an index angle at approximately 40°.

Figure 3C:
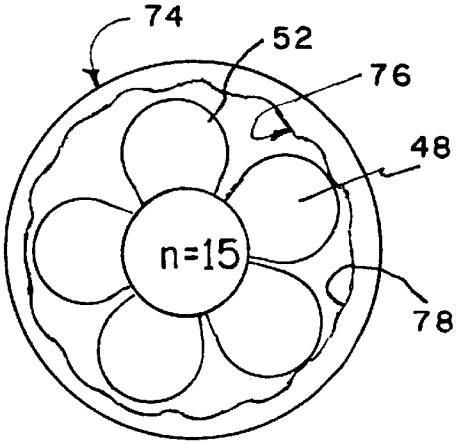
Figure 4B:
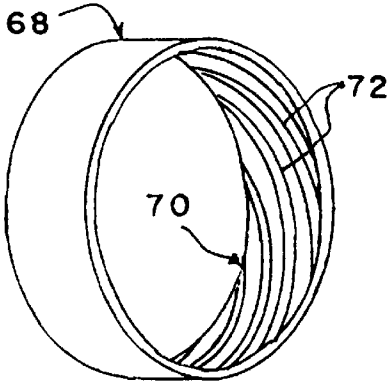
Figure 4C:
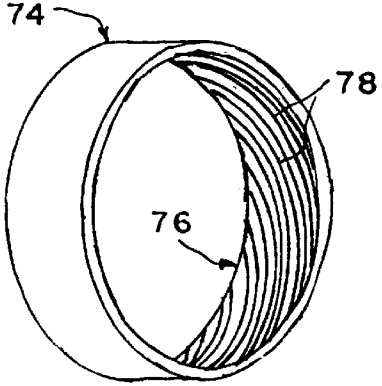
Figure 8C:
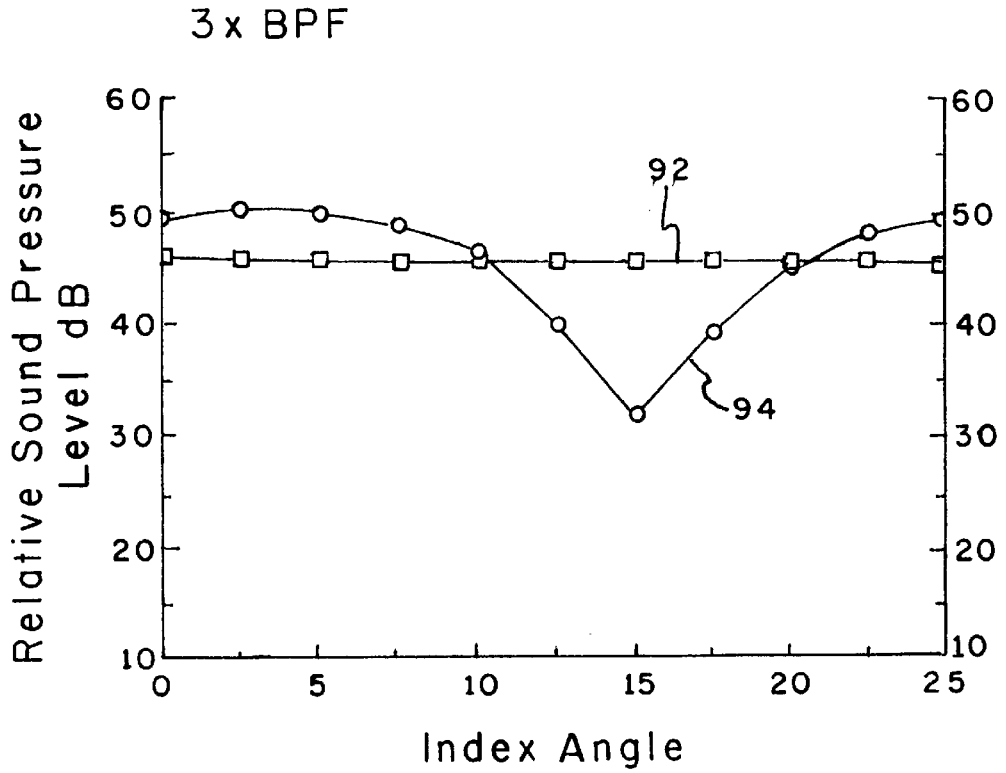

FIG. 8C presents a curve 92 which is a smooth inner surface and a curve 94 which represents the sinusoidal variations of 15 periods as occurs in the inner surface 76 of the shroud 74, all as seen in FIGS. 3C, 4C, and 6C. In this instance, a minimum SPL occurs at an index angle at approximately 15°.

Additionally, the technique of the invention is self-tuning in that it is not in any way affected by the RPM of the rotor. From all of the foregoing, it is clear that the technique of the invention is relatively simple as compared to active control methods. The sinusoidally shaped inner surface of the shroud merely replaces an existing smooth inner surface. No other alterations are required. Furthermore, the technique is passive in that it requires no external energy source. Even the actuator 60, pinion 62, and annular rack 64 need not be used if a proper compromise position is determined a priori for a particular recurring condition. By periodically varying the tip clearance adjoining a rotor or stator, discrete frequency tones can be significantly reduced.

Utilizing the concept of the invention, reduction of several harmonics of the fundamental BRF tone may be achieved simultaneously by employing a shroud whose inner surface contour is defined as a Fourier series such that a tip clearance variation is able to reduce first, second, and third BRF tones concurrently. Such a tip clearance variation may be defined by the following equation:

$$R(\theta)=\Sigma c_n \cos(n\theta+\phi_n)$$

where $R(\theta)$ is the shroud or end-wall inner radius;

$c_n$ is a coefficient representing the amplitude of the cosine function;

n is the number of cycles around the end-wall and an integer multiple of the blade number;

$\theta$ is the angular position (radians); and $\phi_n$ is the phase angle (radians) relative to a common origin.

In addition to the zeroth order term, the inner radius is defined precisely by the fifth, tenth and fifteenth order coefficients and phases. Estimates of the proper phase angles are determined by noting the position of the upstream wake generator with respect to a common reference for the five-, ten- and fifteen-cycle tip clearance variations tested during the second experimental phase. The Fourier coefficients are reduced compared to the amplitudes of the clearance variations used in the second phase experiments. This is done to maintain the same nominal clearance among the shrouds. Because of the smaller coefficients, i.e., shallower grooves, smaller total reductions were expected than those observed during the second experimental phase.

Figure 9:
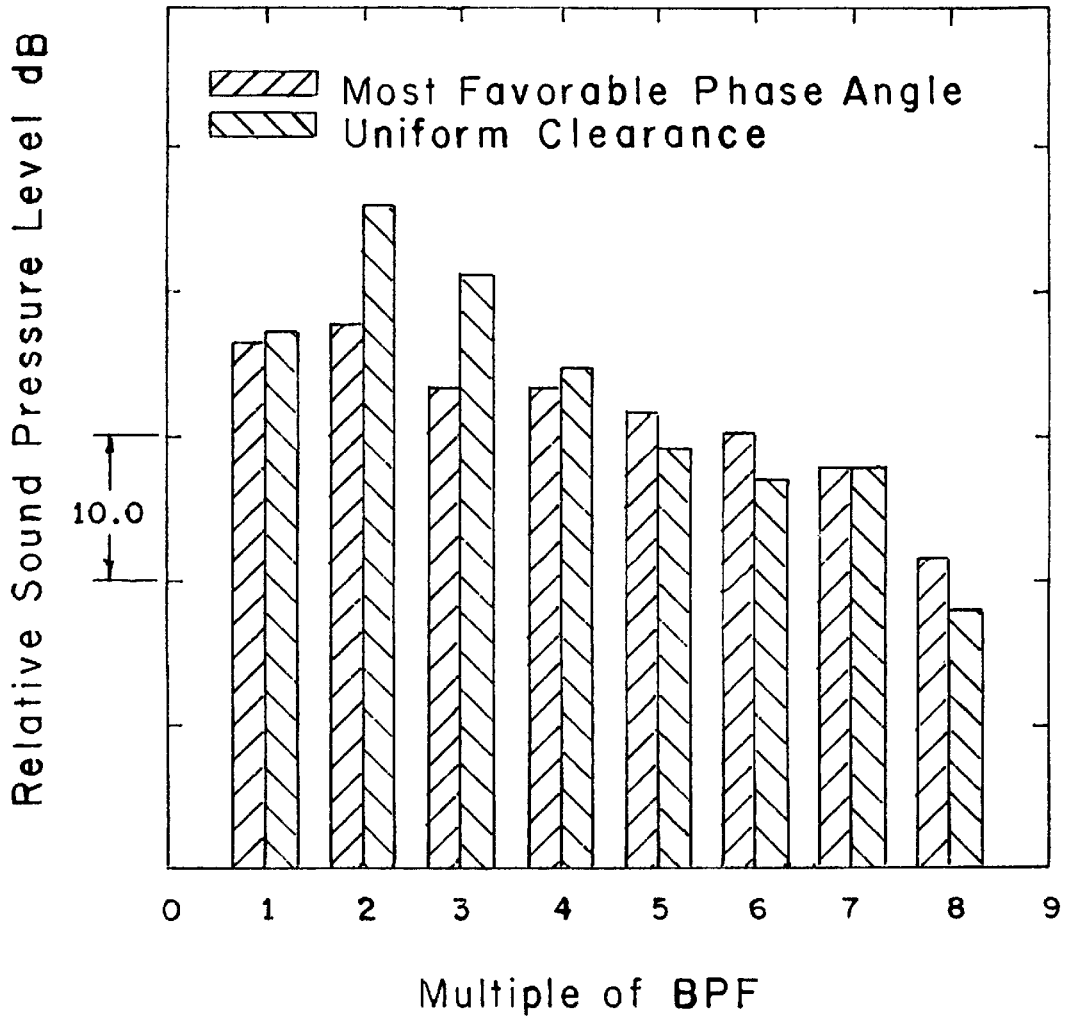
FIG. 9 is a bar graph presenting the relative SPL (sound pressure level) of harmonic tones for tip clearance variation defined as a Fourier series.
Figure 10:
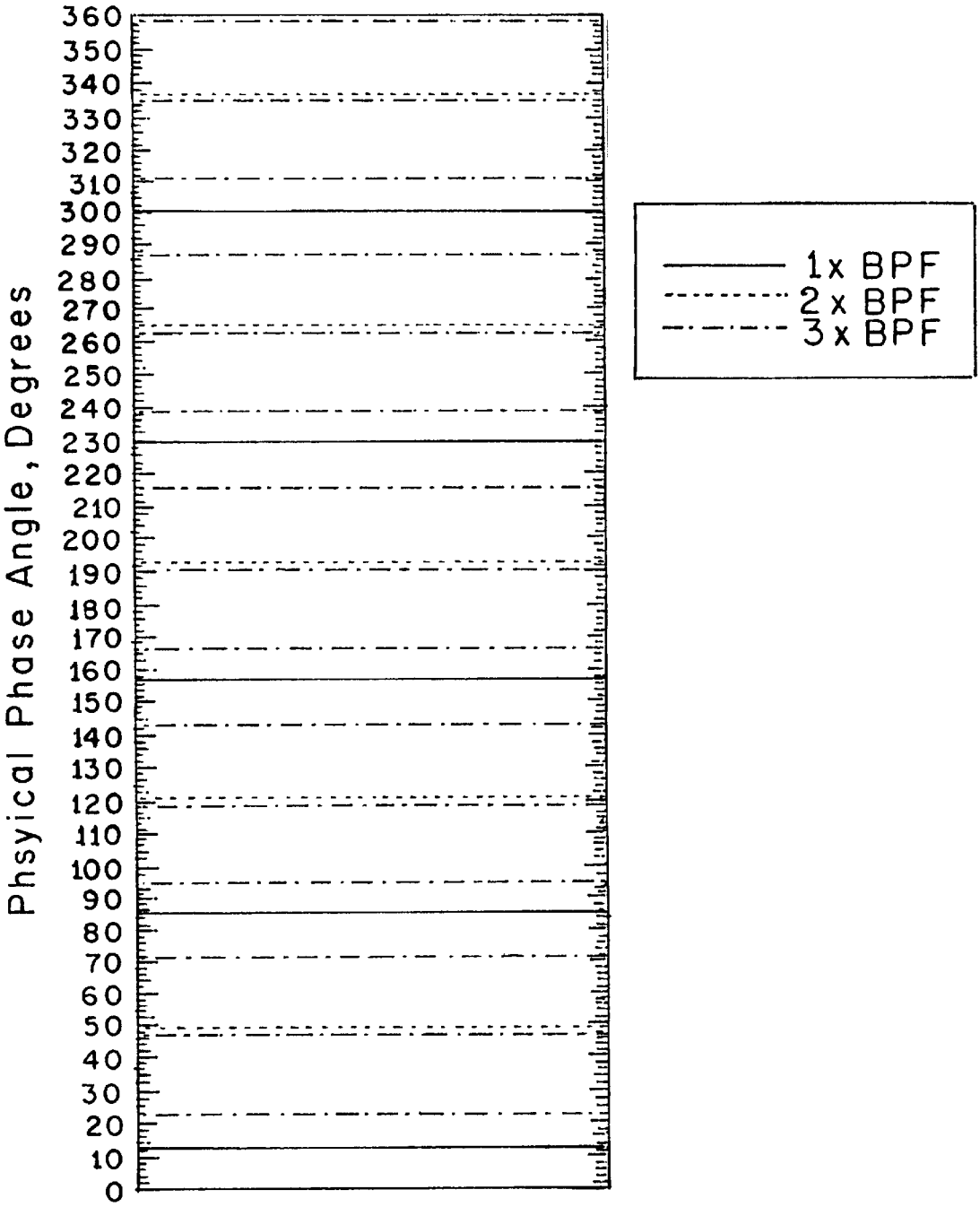
FIG. 10 is a chart presenting phase angle relationships for tip clearance variation defined a s a Fourier series.
Figure 11:
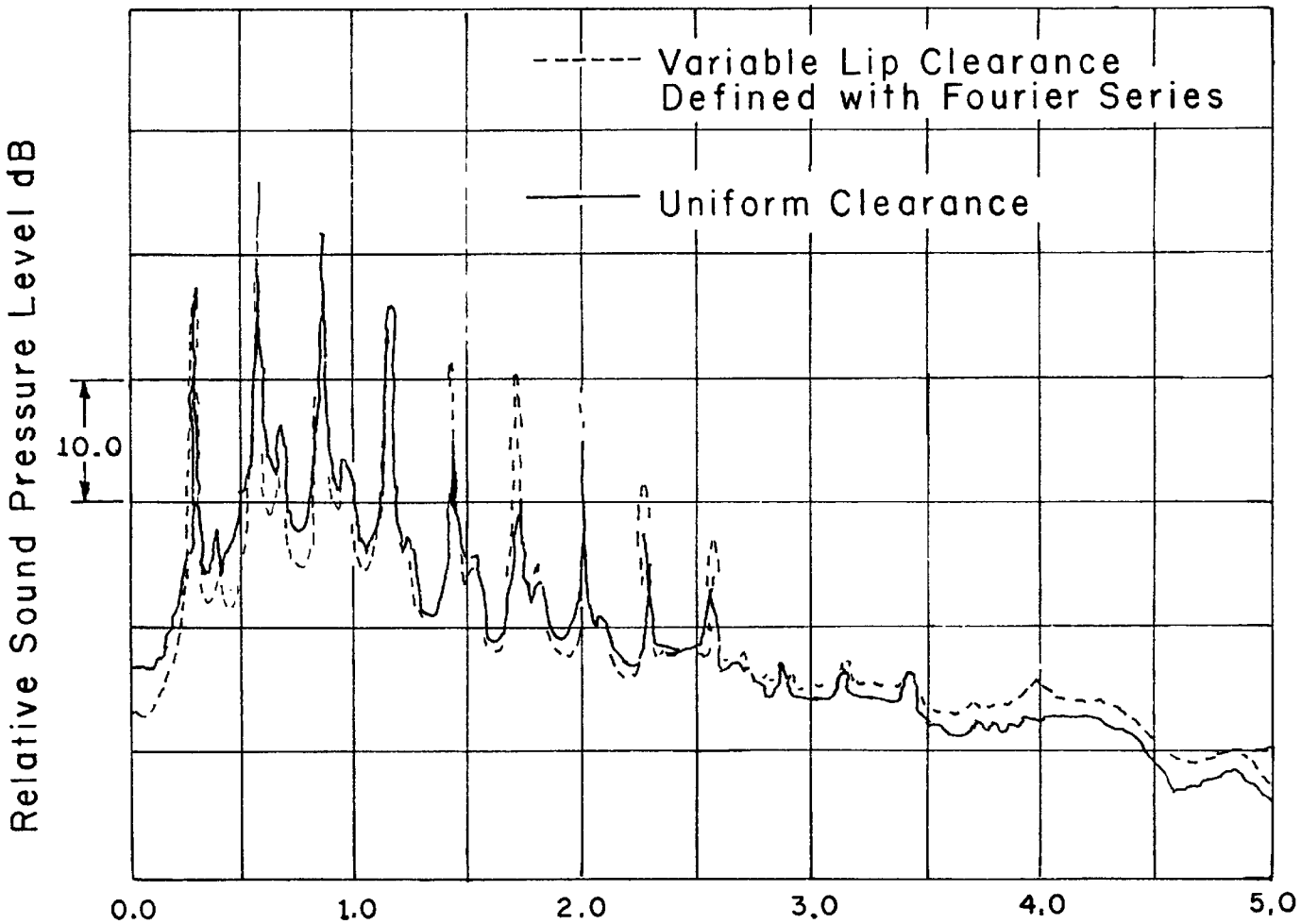
FIG. 11 is a graph presenting a comparison of SPL spectra for variable tip clearance and for uniform tip clearance.

The resulting end-wall contour was evaluated in an anechoic chamber along with a smooth end-wall of the same nominal clearance, 0.71 mm (0.028 in), for comparison. The first, second and third BRF tones were reduced by 0.8, 8.2 and 7.8 dB, respectively. The reduction at the first tone was marginal and likely could have been improved by increasing the value of the coefficient $C_5$. A bar graph of the first through eighth tones is given in FIG. 9 at a "favorable" phase angle, where some reduction was evident on the first, second and third BRF tones. The sound pressure level (SPL) of the fourth harmonic decreased, the seventh remained the same, and the fifth, sixth and eighth BRF tones increased. The phase angles which minimized the first, second and third BRF tones were not coincident as shown in FIG. 10. Horizontal lines for the first, second and third BRF tones are shown in FIG. 10 where their respective levels are minimized. No angle exists at which the three types of lines overlap. This was probably due to experimental uncertainty in the earlier phase angle measurements and the asymmetry of the cycle as shown in FIG. 8. Moreover, as the harmonic number increases, the range of operating positions which reduce the desired tone becomes increasingly smaller, as shown in FIG. 8C. Furthermore, the broadband level of the autospectrum, compared to the uniform clearance, was increased slightly by the variable tip clearance as shown in FIG. 11. Even though the nominal tip clearance was the same for both the uniform clearance and the variable clearance cases, the average clearance for the latter is actually larger by about 0.36 mm (0.014 in). This could be responsible for the slight increase in the broadband level.

Figure 12:
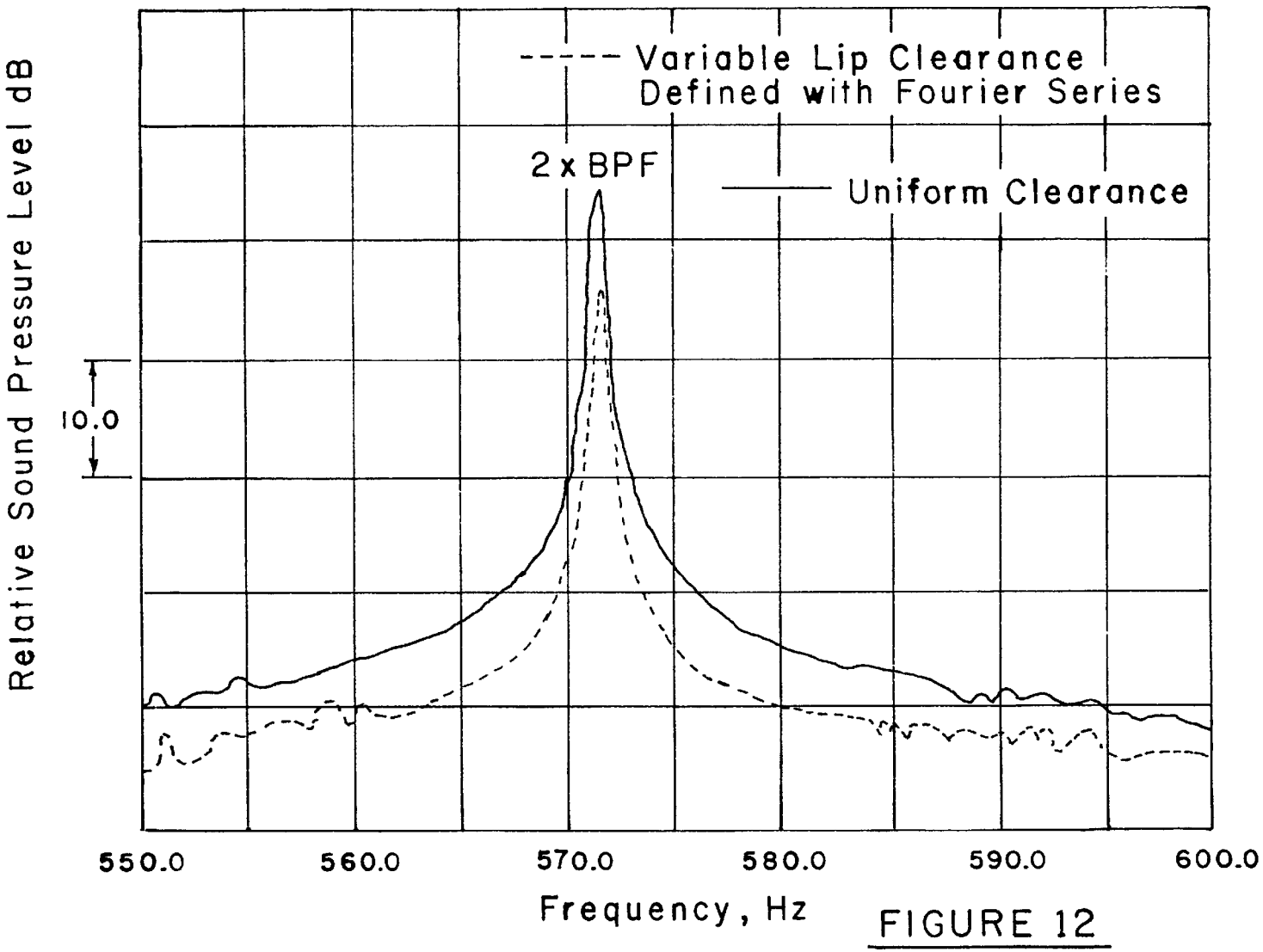
FIG. 12 is a narrow band SPL (0.125 Hertz bandwidth) spectrum centered on the second BRF tone

Mathematically, it can be shown that amplitude, phase or frequency modulation of a periodic signal introduces side bands. Amplitude modulation adds side bands to the spectrum without suppressing the main tone(s). However, the use of phase and frequency modulation can result in reduction(s) of the main tone(s). In order to investigate the occurrence of side bands from the variable tip clearance effect, sound pressure spectra were recorded in bandwidths of 0.125 Hz centered about the first through seventh BRF tones. As shown in FIG. 12, for example, no side bands were observed for the second harmonic tone. Spectra for other BRF tones are similar. The variable tip lift concept cannot be described by modulation theory; on the contrary, it is another source of unsteady force which, by design, is tuned with one or more harmonics of the fluctuating force acting on the rotor from the nonuniform inflow. Since the variable tip clearance is fixed to the stationary frame, the resulting unsteady force on the blade tip is self-tuning; if the RPM and hence the BRF changes, the frequency of the tip force is inherently changed.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. Apparatus for reducing acoustic radiation which occurs during the operation of turbomachinery comprising:

a shroud having a generally cylindrical inner surface;

a rotor coaxial with said shroud and including a plurality of uniformly shaped and sized blades extending generally radially outwardly to tip ends proximate to said inner surface at equally spaced circumferential locations;

means rotatably mounting said rotor within said shroud; said inner surface of said shroud being circumferentially contoured such that the tip clearance between each of said blades and said inner surface is caused to vary in a periodic manner upon rotation of said rotor so as to create a new periodic unsteady pressure field which is substantially equal to, and out of phase with, an existing periodic pressure field resulting from nonuniform inflow into said blades and results in the radiation from said turbomachinery of reduced blade rate frequency tones, said inner surface of said shroud being a circumferential sinusoidal contour whose periodicity is an integral multiple of the number of said blades.

2. Apparatus for reducing acoustic radiation as set forth in claim 1 wherein a plane of said tip end of each of said blades, being an attack plane, is angularly disposed relative to a plane perpendicular to the axis of said shroud; and wherein said contoured inner surface includes a plurality of parallel grooves generally aligned with the attack plane of each of said blades.

3. Apparatus for reducing acoustic radiation as set forth in claim 1 including:

adjustment means for indexing said shroud on its longitudinal axis until an optimized reduction of blade rate frequency tones has been achieved.

4. Apparatus for reducing acoustic radiation as set forth in claim 1 wherein said inner surface of said shroud has a circumferential sinusoidal contour defined as a Fourier series such that a reduction of a plurality of harmonics of the blade rate frequency tones is achieved simultaneously.

5. A method of minimizing acoustic radiation which occurs during the operation of turbomachinery comprising the steps of:

(a) providing a shroud having a longitudinal axis and a generally cylindrical inner surface;

(b) rotating on an axis coaxial with the shroud a rotor including a plurality of uniformly shaped and sized blades located at equally spaced circumferential locations and extending radially outwardly to tip ends proximate to the inner surface of the shroud; and (c) varying the tip clearance between each of the blades and the inner surface of the shroud in a periodic manner upon rotation of the rotor to create a new periodic unsteady pressure field which is substantially equal to, and out of phase with, an existing periodic pressure field resulting from nonuniform inflow into the blades, step (c) further including the step of:

(d) forming the inner surface of the shroud with a circumferential sinusoidal contour whose periodicity is an integral multiple of the number of the blades;

whereby rotation of the rotor results in the radiation from the turbomachinery of reduced blade rate frequency tones.

6. A method of minimizing acoustic radiation as set forth in claim 5 wherein the tip ends of each of the blades lies in an attack plane which is angularly disposed relative to a plane perpendicular to the axis of the shroud; and wherein step (d) includes the step of:

(e) forming the inner surface of the shroud with a plurality of parallel grooves generally aligned with the attack plane of each of the blades.

7. A method of minimizing acoustic radiation as set forth in claim 5 including the step of: indexing the shroud on its longitudinal axis until an optimized reduction of blade rate frequency tones has been achieved.

8. A method of minimizing acoustic radiation as set forth in claim 5 wherein step (d) includes the step of:

(e) forming the inner surface of the shroud with a circumferential sinusoidal contour defined as a Fourier series such that a reduction of a plurality of harmonics of the blade rate frequency tones is achieved simultaneously.

9. Apparatus for reducing acoustic radiation which occurs during the operation of turbomachinery comprising:

a shroud defining a generally cylindrical inner surface encompassing a coaxial rotor including a plurality of uniformly shaped and sized blades extending generally radially outwardly to tip ends proximate to said inner surface at equally spaced circumferential locations;

said inner surface of said shroud being circumferentially contoured such that the tip clearance between each of the blades is caused to vary in a periodic manner upon rotation of the rotor so as to create a new periodic unsteady pressure field which is substantially equal to, and out of phase with, an existing periodic pressure field resulting mainly from nonuniform inflow into the blades and results in the radiation from the turbomachinery of reduced blade rate frequency tones, said inner surface of said shroud having a circumferential sinusoidal contour whose periodicity is an integral multiple of the number of said blades.

10. Apparatus for reducing acoustic radiation as set forth in claim 9 wherein a plane of said tip end of each of said blades, being an attack plane, is angularly disposed relative to a plane perpendicular to the axis of said shroud; and wherein said contoured inner surface includes a plurality of parallel grooves generally aligned with the attack plane of each of said blades.

11. Apparatus for reducing acoustic radiation as set forth in claim 9 including:

adjustment means for indexing said shroud on its longitudinal axis until an optimized reduction of blade rate frequency tones has been achieved.

12. Apparatus for reducing acoustic radiation as set forth in claim 9 wherein said inner surface of said shroud has a circumferential sinusoidal contour defined as a Fourier series such that a reduction of a plurality of harmonics of the fundamental blade rate frequency tone is achieved simultaneously.

13. Apparatus for reducing acoustic radiation as set forth in claim 9 including:

feedback means for indexing said shroud on its longitudinal axis until an optimized reduction of blade rate frequency tones has been achieved.

14. Apparatus for reducing acoustic radiation as set forth in claim 9 including:

active means for varying shroud contour in a time-varying manner using a system of actuators such that a reduction of a plurality of higher harmonics of the fundamental blade rate frequency tone is achieved simultaneously.

* * * * *